US007878706B2

(12) United States Patent
Koch

(10) Patent No.: US 7,878,706 B2
(45) Date of Patent: Feb. 1, 2011

(54) STRIP FOR SECURING A DEVICE

(76) Inventor: Mark Koch, 223 W. 29th St., New York, NY (US) 10001

( * ) Notice: Subject to any disclaimer, the term of this patent is extended or adjusted under 35 U.S.C. 154(b) by 0 days.

(21) Appl. No.: 11/659,517

(22) PCT Filed: May 23, 2005

(86) PCT No.: PCT/US2005/018157

§ 371 (c)(1),
(2), (4) Date: Feb. 5, 2007

(87) PCT Pub. No.: WO2006/022942

PCT Pub. Date: Mar. 2, 2006

(65) Prior Publication Data

US 2008/0074957 A1 Mar. 27, 2008

Related U.S. Application Data

(60) Provisional application No. 60/598,633, filed on Aug. 4, 2004, provisional application No. 60/598,632, filed on Aug. 4, 2004.

(51) Int. Cl.
*G04B 37/00* (2006.01)

(52) U.S. Cl. ..... 368/282; 224/164

(58) Field of Classification Search ..... 368/282; 224/164

See application file for complete search history.

(56) References Cited

U.S. PATENT DOCUMENTS

| | | | | | |
|---|---|---|---|---|---|
| 2,639,254 | A * | 5/1953 | Smith | 156/108 |
| 2,896,351 | A * | 7/1959 | Johnson | 40/702 |
| 4,117,616 | A * | 10/1978 | Penton | 40/550 |
| 4,505,597 | A * | 3/1985 | Flinn, Jr. | 368/250 |
| 4,682,310 | A * | 7/1987 | Lund et al. | 368/278 |
| 4,916,679 | A * | 4/1990 | Agnello | 368/283 |
| 4,920,526 | A * | 4/1990 | Saito | 368/281 |
| 6,227,424 | B1 * | 5/2001 | Roegner | 224/219 |
| 2006/0161088 | A1 * | 7/2006 | Voetsch | 602/43 |
| 2007/0047389 | A1 * | 3/2007 | Realdine | 368/10 |

* cited by examiner

*Primary Examiner*—Renee Luebke
*Assistant Examiner*—Sean Kayes
(74) *Attorney, Agent, or Firm*—Nathaniel T. Wallace, Esq.

(57) ABSTRACT

A personal attachment device includes a strip (101) having a first side (105) and a second side (106), the first side (105) of the strip (101) having an adhesive backing, the strip (101) including a hole formed between the first (105) and second (106) sides, and a device (103) for insertion into the hole, the device (103) including a flange (104) for contacting the first side (105) of the strip (101) upon insertion of the device (103) into the hole from the first side (105) to the second side (106), wherein the adhesive (107) is adapted to secure the strip (101), and thereby the device (103), to a substrate.

7 Claims, 4 Drawing Sheets

STRIP FOR SECURING A DEVICE

This application claims priority to U.S. Provisional Application Ser. No. 60/598,633, filed on Aug. 4, 2004, and 60/598,632 filed on Aug. 4, 2004, which are herein incorporated by reference in their entirety.

BACKGROUND OF THE INVENTION

1. Field of the Invention

The present invention relates to a personal attachment device, and more particularly to a strip for securing a device.

2. Discussion of Related Art

Wristwatches include a timepiece and a wristband for securing the timepiece to one's arm. Typically the wristband may be removed and replaced using specialized tools. However, the wristbands themselves may be expensive and difficult to replace.

Therefore, a need exists for a device and strip system for securing a device to a substrate.

SUMMARY OF THE INVENTION

According to an embodiment of the present disclosure, a personal attachment device comprises a strip having a first side and a second side, the first side of the strip having an adhesive backing, the strip including a hole formed between the first and second sides, and a device for insertion into the hole, the device including a flange for contacting the first side of the strip upon insertion of the device into the hole from the first side to the second side, wherein the adhesive is adapted to secure the strip, and thereby the device, to a substrate.

The flange is a projection of the device, wherein the flange forms a based of the device. The adhesive backing contacts the flange to secure the device.

The strip is a band.

The adhesive adheres the strip to a substrate, securing the device, securing the device between the strip and the substrate.

The device includes a sidewall disposed substantially perpendicular to the strip, and wherein the flange includes a top surface for contacting the adhesive, wherein a surface finish of the sidewall of the device is irregular as compared to a finish of the top surface of the flange.

The strip is perforated.

According to an embodiment of the present disclosure a personal attachment device comprises a band having a first side and a second side, including a hole formed between the first and second sides, and a device inserted into the hole, the device including a flange contacting one of the first side or the second side and preventing the device from passing completely through the hole.

The band encompasses a substrate, the flange being captured between the band and the substrate, securing the device in the hole.

According to an embodiment of the present disclosure, a personal attachment device comprises a strip having a first side and a second side, the first side of the strip having a first adhesive backing, and a device coupled to the second side of the strip by a second adhesive backing.

BRIEF DESCRIPTION OF THE FIGURES

Preferred embodiments of the present invention will be described below in more detail, with reference to the accompanying drawings.

DETAILED DESCRIPTION OF PREFERRED EMBODIMENTS

A strip or band secures a device to a substrate, for example, a user's arm or leg. The strip is formed of a fabric or plastic material having a first and second side. The first side of the strip has an adhesive backing for adhering to a user or other substrate. The adhesive bonds to the substrate such that the strip is removable.

Figure 1A:
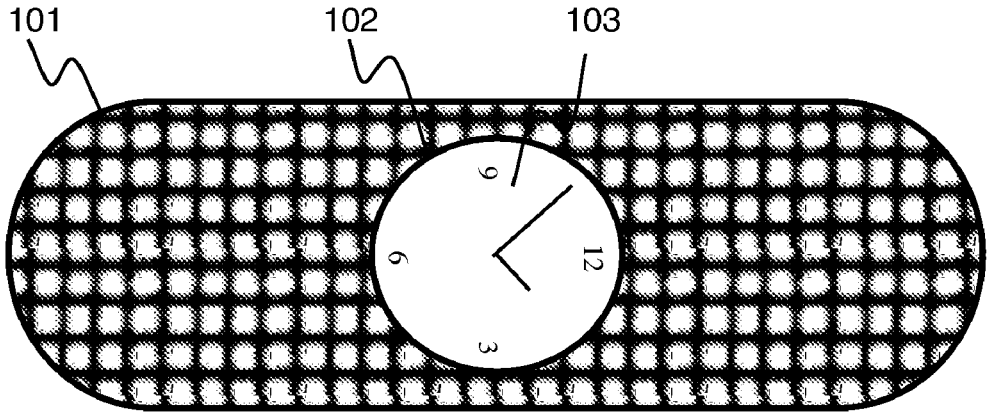
FIG. 1A is a top-down view of a band and a device according to an embodiment of the present disclosure.
Figure 1B:
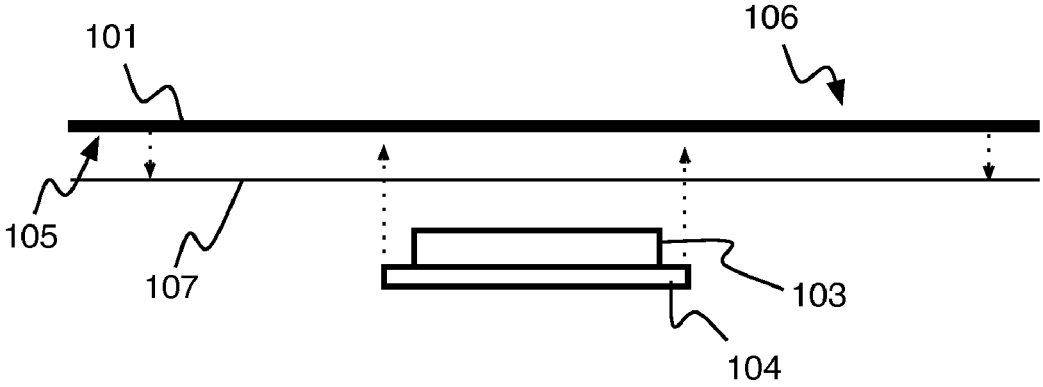
FIG. 1B is a side-view of a band and a device according to an embodiment of the present disclosure.
Figure 1C:
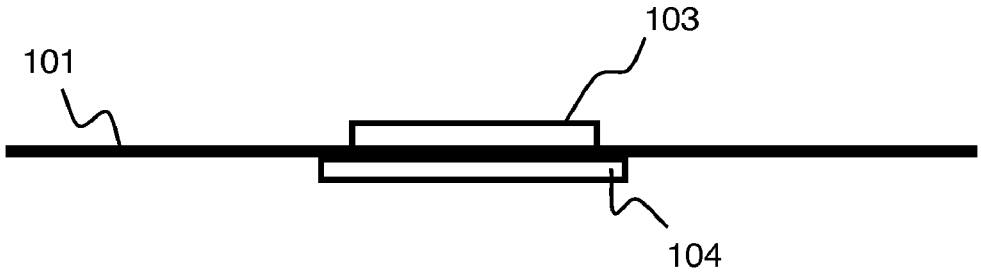
FIG. 1C is a side-view of a band and device, wherein the device is secured in a hole of the band according to an embodiment of the present disclosure.
Figure 2:
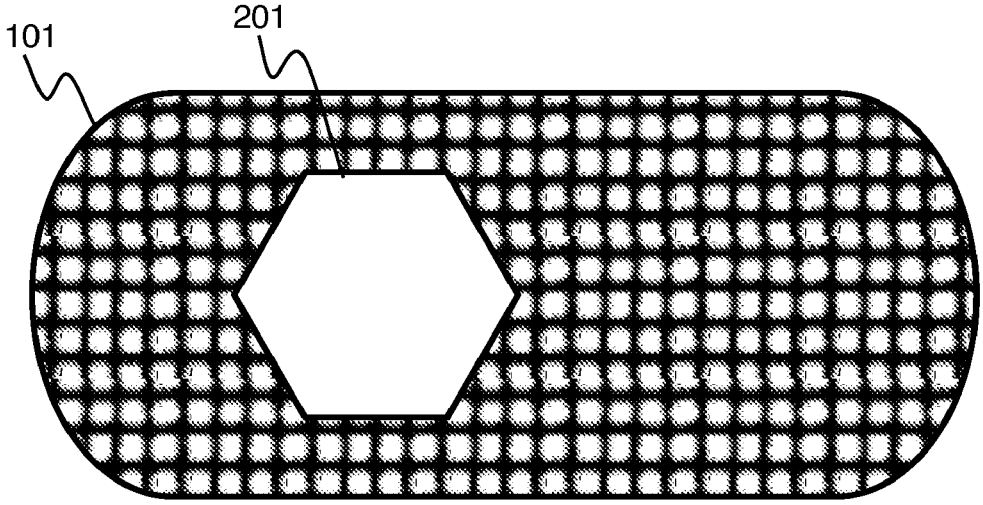
FIG. 2 is a top-down view of a band according to an embodiment of the present disclosure.

Referring to FIGS. 1A-C, the strip 101 further comprises a hole 102 for receiving a device 103 such as a digital timepiece. The device 103 comprises a flange 104 having a dimension, e.g., diameter, larger than a corresponding dimension of the hole 102. Other shaped holes may be implemented, such as a polygon 201 (see FIG. 2). The adhesive is bonded to the first side 105 of the strip 101. The adhesive contacts the flange 104 to secure the device 103 and prevent rotation of the device 103 in the hole 102.

The strip 101 may have design or graphic image printed thereon, for example, on the second side 106 or on the first side 105 where the strip is a translucent material. The strip 101 may be implemented having a shape, such as a square or triangle, capable of securing a timepiece. The strip 101 has a thickness adapted to maintain a form, e.g., about 0.2 millimeters in a plastic film. The thickness can be varied, and preferably provides sufficient rigidity to the strip to prevent the hole from collapsing under the weight of the strip. Further, the strip 101 is perforated, for example, having about 400 perforations per square inch. Perforation substantially prevents delamination of the strip 101 from a skin substrate.

A removable covering 107 is provided on the first side 105, over the adhesive. The removable covering 107 may be comprised of one or more components, e.g., 304-305, as shown in FIG. 3B. The removable covering 107 is easily removed to expose the adhesive for applying the strip 101 to a substrate and securing the device 103. The adhesive has a tack or bonding strength (e.g., peel strength) sufficient for securing the device and capable of being removed from a substrate such as skin without causing undue discomfort. Further, the adhesive is water-resistant.

Figure 3A:
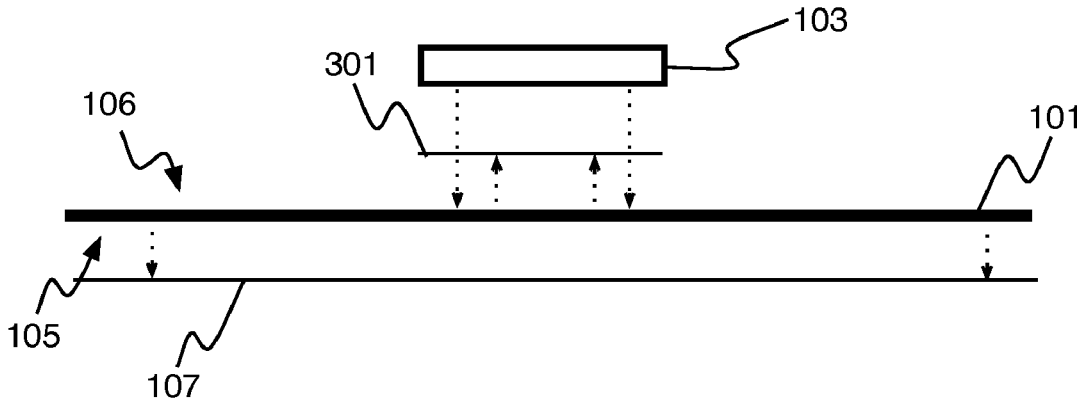
FIGS. 3A and 3B are side-views of means for coupling a device to a band according to an embodiment of the present disclosure.
Figure 3B:
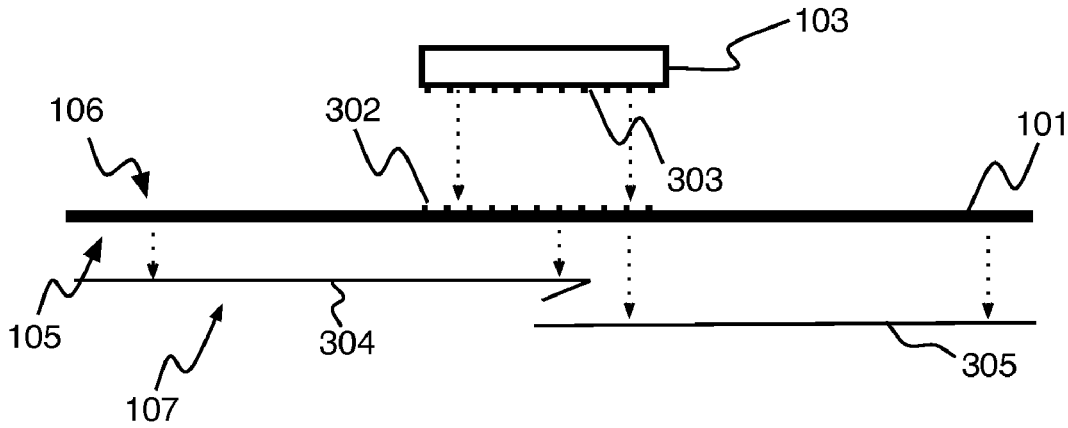

Referring to FIGS. 3A and 3B, the strip 101 may not have a hole for receiving the device 103; the device 103 is coupled to the second side 106 of the strip 101. For example, the device 103 may be coupled to the strip by adhesive applied to the second side 106, and blanketed by a removable covering 301. Upon lifting the removable covering from the strip 101, the device may be applied to the strip 101. Other means for coupling the device 103 to the strip 101 may be used, for example, Velcro® 302/303 on the strip 101 and device 103 or a snap may be implemented having complementary connectors on the strip 101 and device 103.

According to an embodiment of the present disclosure, the strip includes adhesive on the first side and the second side, similar to FIG. 3A. The strip may have a size equal to or smaller than the device. The strip is bonded to both the device and the user as shown in FIG. 3A. However, only the device may be visible, as the device conceals the strip.

According to an embodiment of the present disclosure, the strip may be adhered to any portion of a user's body, for example, a wrist or ankle. The strip may also be secured to a substrate such as, clothing, a desk, or an automobile's dashboard.

According to an embodiment of the present disclosure, a strip may comprise more than one hole for receiving multiple devices.

Figure 4:
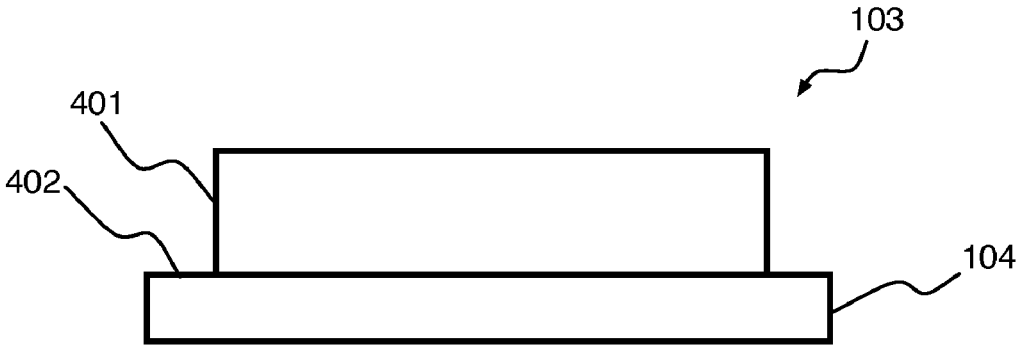
FIG. 4 is a view of a device according to an embodiment of the present disclosure.

Referring now to FIG. 4 and a device 103 to be used in combination with a strip 101 according to an embodiment of the present disclosure; the device includes a sidewall 401. The sidewall 401 includes a matte finish/texture adapted to reduce the potential for bonding to the adhesive of the strip 101 as the device is inserted into the whole of the strip 101. The flange 104 includes an upper surface 402 having a gloss finish. Thus, the upper surface 402 has superior bonding characteristics as compared to the sidewall 401.

The device 103 may be formed from as a signal rigid thermoplastic such as a polycarbonate or the like. The device 103 may be formed from two or more thermoplastics, wherein, an upper portion of the device is formed of a rigid thermoplastic and the flange is formed of a flexible material such as silicone. The flexible material can contour around uneven substrates.

Figure 5:
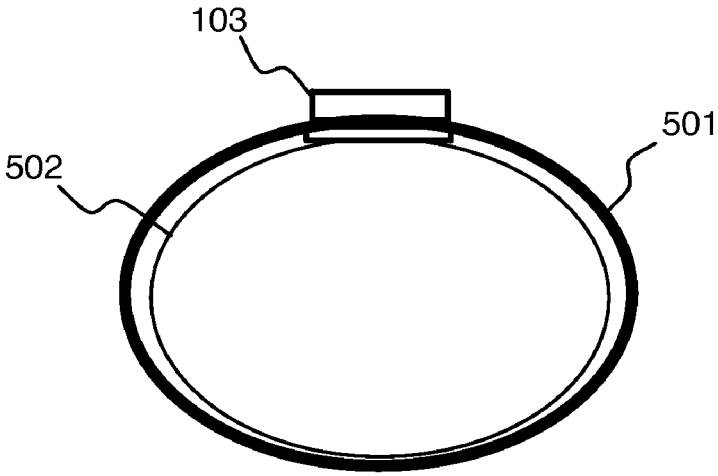
FIG. 5 is a view of a circular band according to an embodiment of the present disclosure.

Referring to FIG. 5, the strip may be a band 501. The band 501 may be formed of an elastic rubber. The band 501 has a size adapted to fit over a cylindrical substrate 502, such as person's wrist. The fit of the band 501 over the substrate 502 secures a device 103 between the band 501 and the cylinder 502 without the need of an adhesive, wherein the flange of the device 103 is captured between the band 501 and the substrate 502.

Having described embodiments for personal attachment device, it is noted that modifications and variations can be made by persons skilled in the art in light of the above teachings. It is therefore to be understood that changes may be made in the particular embodiments of the invention disclosed which are within the scope and spirit of the invention as defined by the appended claims. Having thus described the invention with the details and particularity required by the patent laws, what is claimed and desired protected by Letters Patent is set forth in the appended claims.

What is claimed is:

1. A personal attachment device comprising:

a strip having a first side and a second side, the first side of the strip having an adhesive backing disposed on an entire surface thereof, the strip including a hole formed between the first and second sides, wherein the strip is perforated; and a device for insertion into the hole, the device including a flange for contacting the first side of the strip upon insertion of the device into the hole from the first side to the second side, wherein the adhesive is adapted to secure the strip, and thereby the device, to a substrate, wherein the strip comprises about 400 perforations per square inch, substantially preventing delamination of the strip.

2. The personal attachment device of claim 1, wherein the flange is a projection of the device, wherein the flange forms a base of the device.

3. The personal attachment device of claim 1, wherein the adhesive backing contacts the flange to secure the device.

4. The personal attachment device of claim 1, wherein the adhesive adheres the strip to a substrate, securing the device between the strip and the substrate.

5. The personal attachment device of claim 1, wherein the device includes a sidewall disposed substantially perpendicular to the strip, and wherein the flange includes a top surface for contacting the adhesive, wherein a surface finish of the sidewall of the device is a matte finish and a finish of the top surface of the flange is a gloss finish, wherein the top surface of the flange has superior bonding characteristics as compared to the sidewall of the device.

6. The personal attachment device of claim 1, wherein the adhesive backing has a bonding strength adapted for making the strip removable from the substrate.

7. A personal attachment device comprising:

a strip having a first side and a second side, the first side of the strip having an adhesive backing disposed on an entire surface thereof, the strip including a hole formed between the first and second sides; and a device for insertion into the hole, the device including a flange for contacting the first side of the strip upon insertion of the device into the hole from the first side to the second side, wherein the adhesive is adapted to secure the strip, and thereby the device, to a substrate, wherein the device includes a sidewall disposed substantially perpendicular to the strip, and wherein the flange includes a top surface for contacting the adhesive, wherein a surface finish of the sidewall of the device is a matte finish and a finish of the top surface of the flange is a gloss finish, wherein the top surface of the flange has superior bonding characteristics as compared to the sidewall of the device.

* * * * *